US007489292B2

(12) United States Patent
Kasai

(10) Patent No.: US 7,489,292 B2
(45) Date of Patent: Feb. 10, 2009

(54) DRIVING CIRCUIT, ELECTRO-OPTICAL DEVICE, METHOD OF DRIVING THE SAME, AND ELECTRONIC APPARATUS

(75) Inventor: Toshiyuki Kasai, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 768 days.

(21) Appl. No.: 11/006,713

(22) Filed: Dec. 8, 2004

(65) Prior Publication Data

US 2005/0156837 A1 Jul. 21, 2005

(30) Foreign Application Priority Data

Jan. 21, 2004 (JP) ..... 2004-013201

(51) Int. Cl.
*G09G 3/30* (2006.01)

(52) U.S. Cl. ..... 345/76

(58) Field of Classification Search ..... 345/76
See application file for complete search history.

(56) References Cited

U.S. PATENT DOCUMENTS

| | | | | |
|---|---|---|---|---|
| 6,359,605 | B1 * | 3/2002 | Knapp et al. | 345/76 |
| 6,661,180 | B2 * | 12/2003 | Koyama | 315/169.3 |
| 6,919,871 | B2 * | 7/2005 | Kwon | 345/92 |
| 6,960,889 | B2 * | 11/2005 | Park et al. | 315/169.2 |
| 6,989,826 | B2 | 1/2006 | Kasai | |
| 7,158,108 | B2 * | 1/2007 | Hagino | 345/89 |
| 2002/0093475 | A1 * | 7/2002 | Hashimoto | 345/87 |
| 2003/0040149 | A1 | 2/2003 | Kasai | |
| 2003/0227262 | A1 * | 12/2003 | Kwon | 315/169.3 |
| 2004/0217925 | A1 * | 11/2004 | Chung et al. | 345/76 |
| 2005/0078077 | A1 * | 4/2005 | Hagino | 345/100 |
| 2005/0099368 | A1 * | 5/2005 | Abe et al. | 345/76 |
| 2006/0066525 | A1 * | 3/2006 | Childs | 345/76 |
| 2006/0119552 | A1 | 6/2006 | Yumoto | |

FOREIGN PATENT DOCUMENTS

| | | |
|---|---|---|
| JP | 2003-114645 A | 4/2003 |
| JP | 2003-122303 A | 4/2003 |
| JP | 2003-195815 A | 7/2003 |
| JP | A-2003-233347 | 8/2003 |
| JP | 2004-037656 A | 2/2004 |
| JP | 2004-177796 | 6/2004 |
| JP | 2005-006250 | 1/2005 |

* cited by examiner

*Primary Examiner*—Bipin Shalwala
*Assistant Examiner*—Afroza Y Chowdhury
(74) *Attorney, Agent, or Firm*—Oliff & Berridge, PLC

(57) ABSTRACT

When respective bits of grayscale data Dx1 are '0' which represents black, upon detection, a NOR circuit of a voltage supply circuit sets an output signal active. Then, a transistor is turned on, and a black voltage VBr is supplied to a data line. By this embodiment, since all transistors of a current supply circuit are turned off, a current is not outputted. Meanwhile, in the case in which a grayscale level to be displayed is other than black, a current Idata is outputted from the current supply circuit.

12 Claims, 11 Drawing Sheets

DRIVING CIRCUIT, ELECTRO-OPTICAL DEVICE, METHOD OF DRIVING THE SAME, AND ELECTRONIC APPARATUS

BACKGROUND

The present invention relates to an electro-optical device using a self-luminous element, a driving circuit and a driving method thereof, and an electronic apparatus using the electro-optical device.

As an image display device taking the place of liquid crystal display devices, a device comprising an organic light emitting diode element (hereinafter, referred to as OLED element) is being noticed. The OLED element is a current-driven self-luminous element, unlike liquid crystal elements which change the amount of light to be transmitted.

In an electro-optical device having the OLED element implemented with an active matrix driving method, a pixel circuit for adjusting the light-emission grayscale level to the OLED element is provided. The setting of the light-emission grayscale level in each pixel circuit is performed by supplying a voltage level or a current level depending on the light-emission grayscale level to the pixel circuit. The method in which the setting of the light-emission grayscale level is performed by the voltage level is called a current-program mode. The pixel circuit in the current-program mode operates to repeat alternately a writing period in which a current depending on the light-emission grayscale level to be supplied from a current generating circuit via a data line is stored and a light emitting period in which the stored current is supplied to the OLED element. The storing of the current level is performed by providing a capacitive element between a gate and a source of a transistor serving as a current source of the OLED element and by storing charges in the capacitive element such that a gate-source voltage of the transistor depends on the current.

Conventionally, as the current-generating circuit which generates the current to the pixel circuit, for example, a construction shown in FIG. 24 of Patent Document 1 may be exemplified. In this drawing, the current-generating circuit is a current-addition D/A converter in which by switching respectively transistors 20*a* to 20*f* depending on each of 6-bit digital data (D0 to D5), element currents i1 to i6 are selected, and the selected element current is synthesized to obtain a current lout. Japanese Unexamined Patent Application Publication No. 2003-233347.

SUMMARY

Additionally, in the conventional current generating circuit, when the current lout depending on black data (grayscale level: 0) is supplied to the data line, all the transistors 20*a* to 20*f* are turned off, and the data line becomes a high impedance state.

However, since the data line is accompanied by a parasitic capacitor, even though the data line is in a high impedance state in a present writing period, it is affected by a just before writing period. For this reason, in the pixel circuit, it is difficult to turn off thoroughly the transistor serving as the current source. As a result, there are problems in that phenomena such as 'black floating' which black display becomes somewhat bright or 'tailing' which black display after white display becomes gray is generated, which consequently deteriorates the display quality.

The present invention is made in consideration of the above-mentioned problems, and it is an object of the present invention to provide a driving circuit which can realize a black display exactly, an electro-optical device using the driving circuit, an electronic apparatus, and a driving method.

In order to solve the problems, there is provided a driving circuit according to the present invention to be used for an electro-optical device comprising a plurality of scanning lines, a plurality of data lines, and a plurality of pixel circuits each provided at intersections of the scanning lines and the data lines, in which each of the pixel circuits includes a self-luminous element, stores a current supplied via each of the data lines, and supplies the stored current to the self-luminous element according to a signal supplied via each of the scanning lines. The driving circuit comprises voltage supply means, when a grayscale level to be displayed is a predetermined grayscale level, for outputting a predetermined voltage to each of the data lines, current supply means, when the grayscale level to be displayed is not the predetermined grayscale level, for outputting a current according to the grayscale level to each of the data lines, and control means, when the grayscale level to be displayed is the predetermined grayscale level, for activating the voltage supply means and deactivating the current supply means, and, when the grayscale level to be displayed is not the predetermined grayscale level, for deactivating the voltage supply means and activating the current supply means.

In a driving method in which a current is supplied to the data line, it is needed to supply the same current as that flowing in an organic light emitting diode to the data line. For this reason, when black is displayed, a current does not flow. However, since the data line is accompanied by the parasitic capacitor, due to influence by a previous state, a place which should display black may not be displayed on black. According to this invention, when a grayscale level to be displayed is a predetermined grayscale level, it is possible to write a predetermined voltage to the data line. Further, when the grayscale level to be displayed is not the predetermined grayscale level, it is possible to output the current depending on grayscale level to the data line. Thus, it becomes possible to display the predetermined grayscale level irrespective of the previous state. Here, the predetermined grayscale level may be a grayscale level in the vicinity of black, not being limited to black (grayscale level 0). That is, a grayscale level less than previously determined reference grayscale level may be the predetermined grayscale level.

Here, preferably, each of the pixel circuits comprises a driving transistor serving as a current source of the self-luminous element, a capacitive element provided between a gate and a source of the driving transistor, and means for storing charges in the capacitive element such that a gate-source voltage of the driving transistor depends on the current supplied via each of the data lines, in which the voltage supply means generates, as the predetermined voltage, a voltage that turns off the driving transistor. In this case, since the driving transistor is thoroughly turned off, a current does not flow in the self-luminous element. As a result, it is possible to display black exactly.

Further, preferably, the driving circuit further comprises power supply means for generating a power supply voltage and for supplying the power supply voltage to a source of the driving transistor of each of the pixel circuits, in which the voltage supply means comprises voltage control means for controlling the predetermined voltage depending on the power supply voltage and generates the predetermined voltage such that the driving transistor is turned off. Since on/off of the driving transistor is determined by a relationship of the power supply voltage and the gate voltage, it is possible to surely display black by generating the predetermined voltage accompanied by the change in power supply voltage.

Further, preferably, when grayscale level to be displayed is the predetermined grayscale level, the current supply means sets an output terminal to a high impedance state. During a first period of a period in which the data lines are selected, the control means connects the voltage supply means to the data line, and during a second period, the control means connects the current supply means to the data line. During the first period in which the data lines are selected, the voltage supply means writes the predetermined voltage into the data line, irrespective of the grayscale level to be displayed.

Further, preferably, when the grayscale level to be displayed is the predetermined grayscale level, the current supply means sets an output terminal to a high impedance state. During a first period of a period in which the data lines are selected, the control means connects the voltage supply means to the data line, and during a second period, the control means connects the current supply means to the data line. In addition, during the first period of the period in which the data lines are selected, when the grayscale level to be displayed is the predetermined grayscale level, the voltage supply means writes the predetermined voltage into the data line, and when grayscale level to be displayed is not the predetermined grayscale level, the voltage supply means writes a precharge voltage into the data line. In this case, since the writing of the predetermined voltage and the writing of the precharge voltage are used together, it is possible to improve display quality with respect to other brightness display, as well as black display.

In the above-mentioned driving circuit, the predetermined grayscale level is preferably black. In this case, when grayscale level to be displayed is black, the predetermined voltage is supplied, and thus it becomes possible to surely display black.

Next, there is provided an electro-optical device according to the present invention comprising a plurality of scanning lines, a plurality of data lines, a plurality of pixel circuits respectively provided at intersections of the scanning lines and the data lines, each pixel circuit having a self-luminous element, a driving transistor serving as a current source of the self-luminous element, a capacitive element provided between a gate and a source of the driving transistor, and means for storing charges in the capacitive element such that a gate-source voltage of the driving transistor depends on a current supplied via the data lines, and a driving circuit as described above. Here, the self-luminous element is preferably an organic light emitting diode. In addition, an electronic apparatus according to the present invention comprises an electro-optical device as described above.

Next, there is provided a method of driving an electro-optical device according to the present invention which comprises a plurality of scanning lines, a plurality of data lines, and a plurality of pixel circuits respectively provided at intersections of the scanning lines and the data lines, in which each of the pixel circuits includes a self-luminous element, stores a current supplied via each of the data lines, and supplies the stored current to the self-luminous element according to a signal supplied via each of the scanning lines. When a grayscale level to be displayed is predetermined grayscale level, a predetermined voltage is generated, and when grayscale level to be displayed is not the predetermined grayscale level, a current depending on grayscale level is generated. When the grayscale level to be displayed is the predetermined grayscale level, the predetermined voltage is supplied to each of the data lines, and when the grayscale level to be displayed is not the predetermined grayscale level, the current depending on the grayscale level to be displayed is supplied to each of the data lines.

Here, preferably, each of the pixel circuits comprises a driving transistor serving as a current source of the self-luminous element, a capacitive element provided between a gate and a source of the driving transistor, and means for storing charges in the capacitive element such that a gate-source voltage of the driving transistor depends on the current supplied via each of the data lines, in which the predetermined voltage is a voltage that turns off the driving transistor. In this case, since the driving transistor is thoroughly turned off, a current does not flow in the self-luminous element. As a result, it becomes possible to display black exactly.

In addition, preferably, a power supply voltage is generated and supplied to a source of the driving transistor of each of the pixel circuits, and the predetermined voltage is controlled depending on the power supply voltage such that the driving transistor is turned off.

Further, there is provided a method of driving an electro-optical device according to present invention comprising a plurality of scanning lines, a plurality of data lines, and a plurality of pixel circuits respectively provided at intersections of the scanning lines and the data lines, in which each of the pixel circuits includes a self-luminous element and a driving transistor for driving the self-luminous element, stores a current supplied via each of the data lines, and supplies the stored current to the self-luminous element according to a signal supplied via each of the scanning lines. Preferably, during a first period of a period in which the data lines are selected, a predetermined voltage that turns off the driving transistor is written into each of the data lines, and during a second period of the period in which the data lines are selected, when grayscale level to be displayed is predetermined grayscale level, the data lines are set to a high impedance state, and when the grayscale level to be displayed is not the predetermined grayscale level, a current depending on grayscale level to be displayed is supplied to each of the data lines.

Further, there is provided a method of driving an electro-optical device according to the present invention comprising a plurality of scanning lines, a plurality of data lines, and a plurality of pixel circuits respectively provided at intersections of the scanning lines and the data lines, in which each of the pixel circuits includes a self-luminous element and a driving transistor for driving the self-luminous element, stores a current supplied via each of the data lines, and supplies the stored current to the self-luminous element according to a signal supplied via each of the scanning lines. During a first period of a period in which the data lines are selected, when a grayscale level to be displayed is a predetermined grayscale level, a predetermined voltage that turns off the driving transistor is written into each of the data lines, and when the grayscale level to be displayed is not the predetermined grayscale level, a precharge voltage is supplied to each of the data lines. And, during a second period of the period in which the data lines are selected, when the grayscale level to be displayed is the predetermined grayscale level, the data lines are set to a high impedance state, and when the grayscale level to be displayed is not the predetermined grayscale level, a current depending on the grayscale level to be displayed is supplied to each of the data lines.

Further, in the method of driving an electro-optical device, the predetermined grayscale level is preferably black. In addition, the self-luminous element is preferably an organic light emitting diode.

DETAILED DESCRIPTION OF EMBODIMENTS

1. First Embodiment

Figure 1:
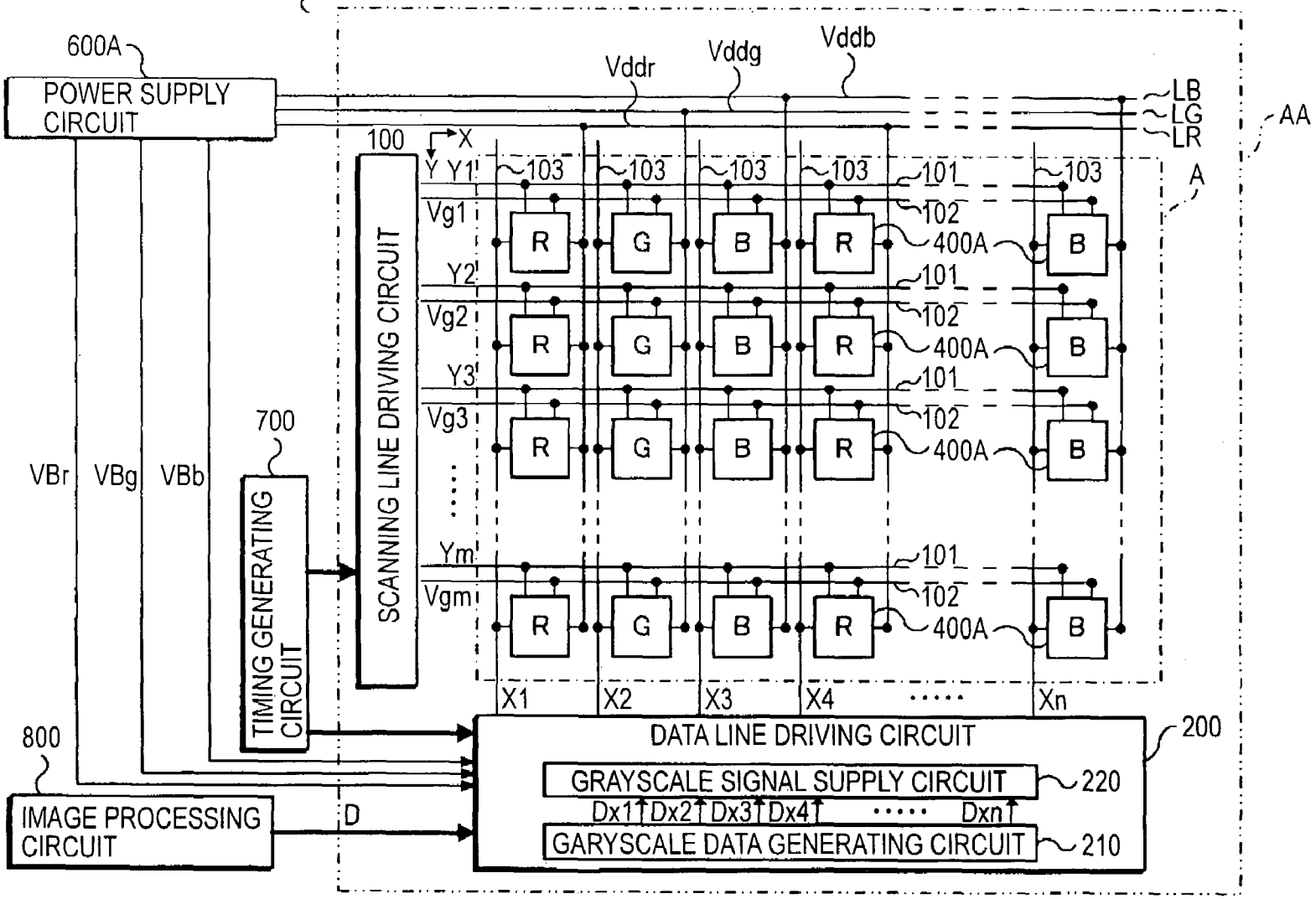
FIG. 1 is a block diagram showing a construction of an electro-optical device according to a first embodiment of the present invention.

FIG. 1 is a block diagram showing a schematic construction of an electro-optical device according to a first embodiment of the present invention. An electro-optical device 1 comprises an electro-optical panel AA and an exterior circuit. In the electro-optical panel AA, a display region A, a scanning line driving circuit 100 and a data line driving circuit 200 are formed. Among them, in the display region A, m scanning lines 101 and m light emission control lines 102 are formed in parallel in an X direction. Further, n data lines 103 are formed in parallel to a Y direction which is orthogonal to the X direction. And then, corresponding to intersections of the scanning lines 101 and the data lines 103, pixel circuits 400A are respectively provided. The respective pixel circuits 400A comprise an OLED element. The marks 'R', 'G' and 'B' shown in FIG. 1 mean 'red', 'green' and 'blue' respectively and represent light emission colors of the OLED elements. In this example, the pixel circuits 400A of the respective colors are arranged along the respective data lines 103.

Further, among the pixel circuits 400A, the pixel circuits 400A corresponding to R color are connected to a power supply line LR, the pixel circuits 400A corresponding to G color are connected to a power supply line LG, and the pixel circuits 400A corresponding to B color are connected to a power supply line LB. A power supply circuit 600A generates power supply voltages Vddr, Vddg and Vddb and black voltages VBr, VBg and VBb. The power supply voltages Vddr, Vddg and Vddb are supplied to the pixel circuits 400A corresponding to the respective RGB colors via the power supply lines LR, LG and LB, and the black voltages VBr, VBg and VBb are supplied to the data line driving circuit 200.

Figure 2:
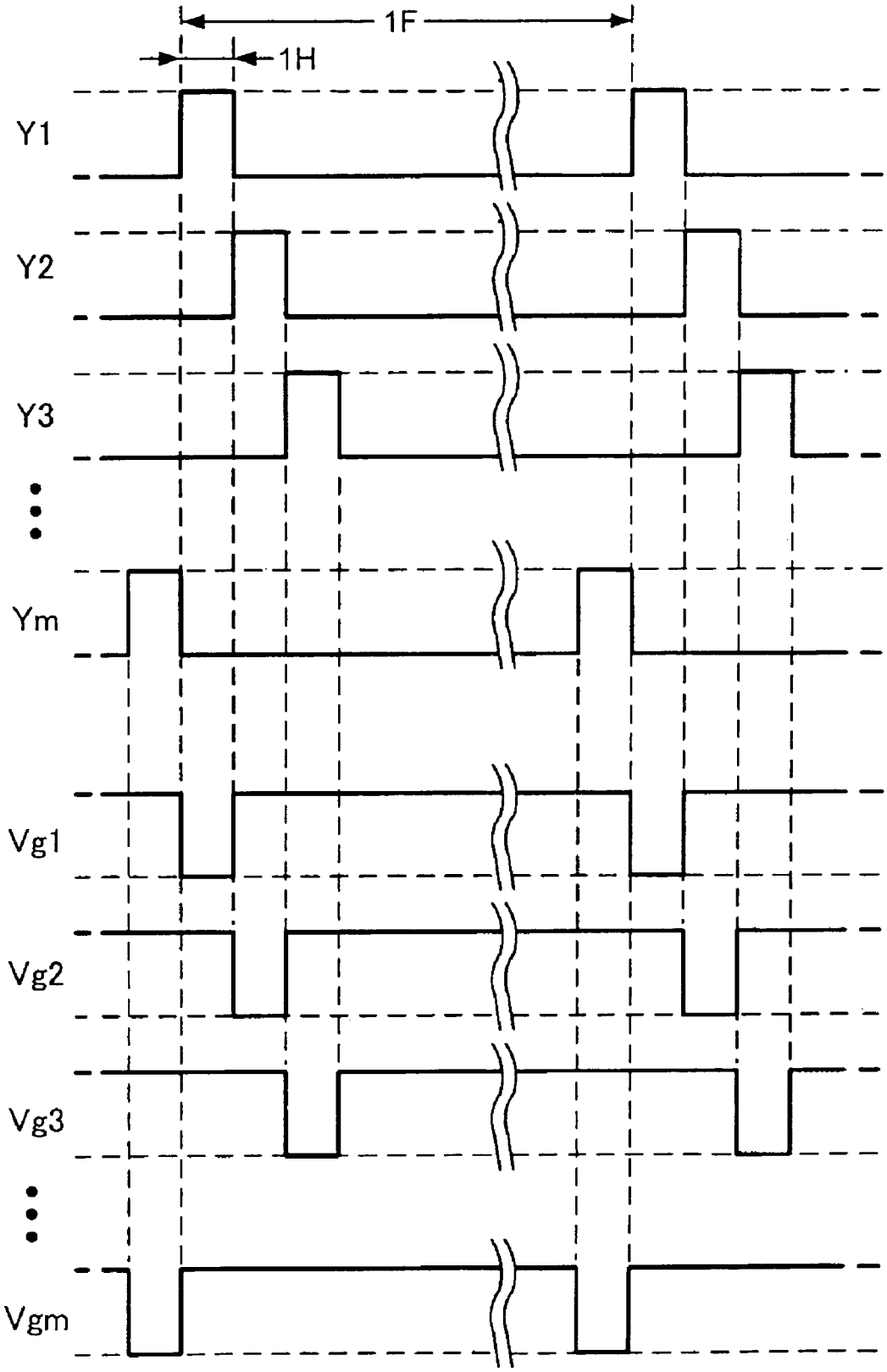
FIG. 2 is a timing chart of a scanning line driving circuit in the electro-optical device.

The scanning line driving circuit 100 generates scanning signals Y1, Y2, Y3, . . . and Ym for sequentially selecting the plurality of scanning lines 101 and light emission control signals Vg1, Vg2, Vg3, . . . and Vgm. The light emission control signals Vg1, Vg2, Vg3, . . . and Vgm are respectively supplied to the pixel circuits 400A via the respective light emission control lines 102. FIG. 2 shows an example of a timing chart of the scanning signals Y1 to Ym and the light emission control signals Vg1 to Vgm. The scanning signal Y1 is a pulse having a width equivalent to one horizontal scanning period (1H) beginning with an initial timing of one vertical scanning period (1F) and is supplied to the scanning line 101 of a first row. Subsequently, this pulse is sequentially shifted and then the shifted pulses are respectively supplied to the scanning lines 101 of second, third, . . . and m-th rows as the scanning signals Y2, Y3, . . . and Ym. Generally, if the scanning signal Yi which is to be supplied to the scanning line 101 of an i-th row (i is an integer satisfying an expression of $1 \leqq i \leqq m$) becomes H level, it means that the corresponding scanning line 101 is selected. Further, as the light emission control signals Vg1, Vg2, Vg3, . . . and Vgm, signals of which logic levels are inverted with respect to the logic levels of the scanning signals Y1, Y2, Y3, . . . and Ym are used.

The data line driving circuit 200 supplies the respective pixel circuits 400A arranged in the selected scanning line 101 with supply grayscale signals X1, X2, X3, . . . and Xn. In this example, the supply grayscale signals X1, X2, X3, . . . Xn may be given as current signals which indicate grayscale brightness. The details of the data line driving circuit 200 will be described later.

A timing generating circuit 700 generates various control signals and outputs them to the scanning line driving circuit 100 and the data line driving circuit 200. Further, an image processing circuit generates grayscale data D on which an image processing such as a gamma correction is performed and outputs it to the data line driving circuit 200. Moreover, in this example, the power supply circuit 600A, the timing generating circuit 700 and the image processing circuit 800 are provided outside the electro-optical panel AA, but a part or all of these elements may be incorporated into the electro-optical panel AA. In addition, a part of elements provided in the electro-optical panel AA may be provided as an exterior circuit.

Figure 3:
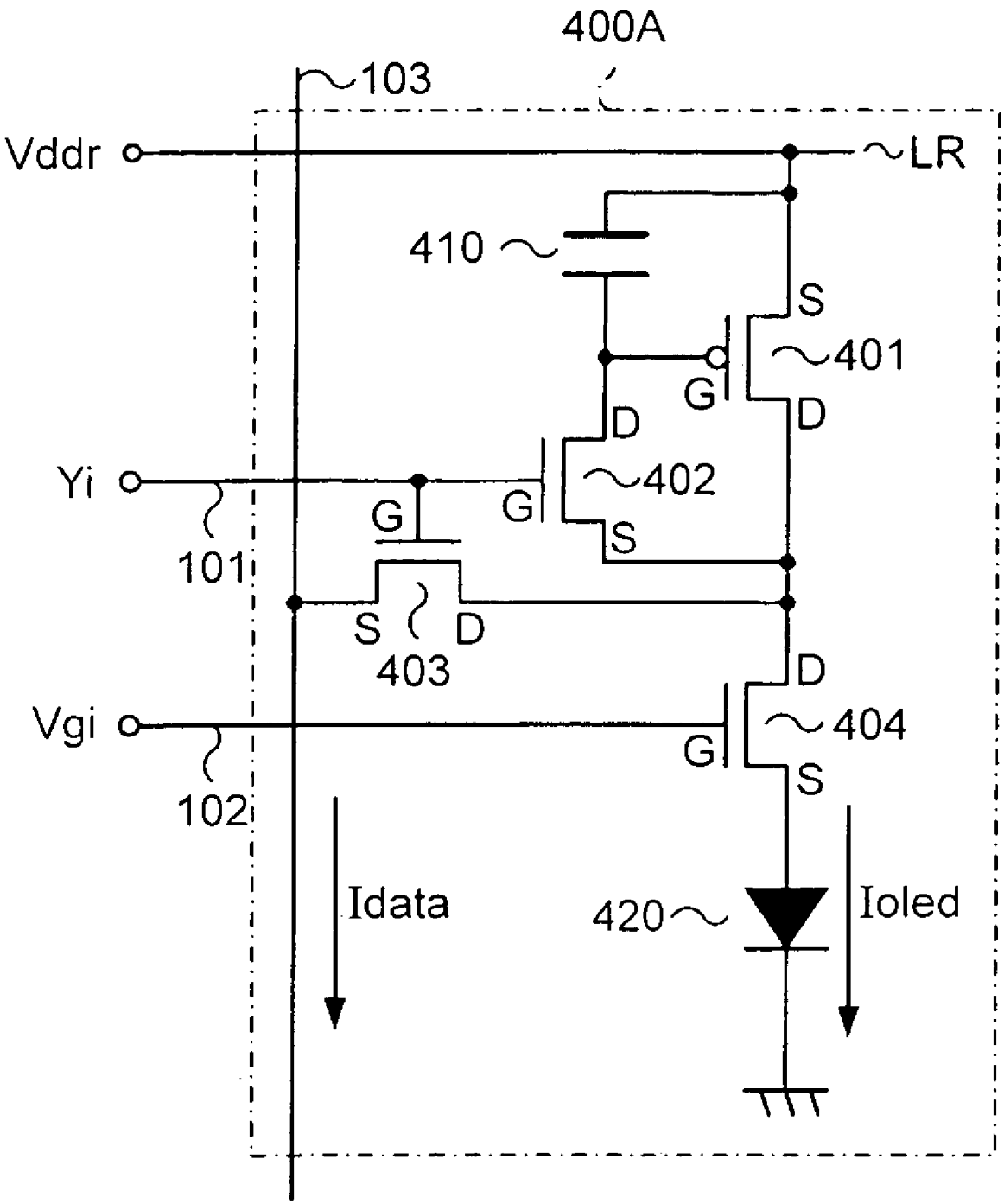
FIG. 3 is a circuit diagram showing a construction of a pixel circuit in the electro-optical device.

Next, the pixel circuit 400A will be described. In FIG. 3, a circuit diagram of the pixel circuit 400A is shown. The pixel circuit 400A shown in FIG. 3 corresponds to R color of the i-th row, to which the power supply voltage Vddr is supplied. The pixel circuits 400A corresponding to other colors are constructed similarly, except that the power supply voltage Vddg (G color) or the power supply voltage Vddb (B color) is supplied, instead of the power supply voltage Vddr. The pixel circuit 400A comprises four thin film transistors (hereinafter, referred to as 'TFT') 401 to 404, a capacitive element 410, and an OLED element 420. Among them, a source electrode of the p-channel type TFT 401 is connected to the power supply line LR and a drain electrode thereof is connected to a drain electrode of the n-channel type TFT 403, a drain electrode of the n-channel type TFT 404 and a source electrode of the n-channel type TFT 402.

One end of the capacitive element 410 is connected to the source electrode of the TFT 403 and other end thereof is connected to a gate electrode of the TFT 403 and a drain electrode of the TFT 402. A gate electrode of the TFT 403 is connected to the scanning line 101 and a source electrode thereof is connected to the data line 103. Further, a gate electrode of the TFT 402 is connected to the scanning line 101. Meanwhile, a gate electrode of the TFT 404 is connected to the light emission control line 102 and a source electrode thereof is connected to an anode of the OLED element 420. Here, the light emission control signal Vgi is supplied via the light emission control line 102. Further, as regards the OLED element 420, a light emitting layer is interposed between the anode and a cathode and light-emits with brightness depending on a forward current. Moreover, the cathode of the OLED element 420 is a common electrode over all the pixel circuits 400A and is set to low level (reference) potential in a power supply.

In such a construction, if the scanning signal Yi becomes H level, the n-channel type TFT 402 is turned on, and then the TFT 401 functions as a diode in which the gate electrode and the drain electrode are connected to each other. If the scanning signal Yi becomes H level, the n-channel type TFT 403 also is turned on, similarly to the TFT 402. As a result, a current Idata of the data line driving circuit 200 flows in a path passing through the power supply line LR, the TFT 401, the TFT 403 and the data line 103. In this situation, charges depending on a potential of the gate electrode of the TFT 401 are stored in the capacitive element 410.

If the scanning signal Yi becomes L level, the TFTs 403 and 402 are turned off. In this situation, since input impedance in the gate electrode of the TFT 401 is extremely high, the charge storing state in the capacitive element 410 is not changed. A gate-source voltage of the TFT 401 is held to a voltage when the current Idata flows. Further, if the scanning signal Yi becomes L level, the light emission control signal Vgi becomes H level. For this reason, the n-channel type TFT 404 is turned on, and then between the source and the drain of the TFT 401, a current Ioled depending on a gate voltage thereof flows. More details, the current flows in a path passing through the power supply line LR, the TFT 401, the TFT 404 and the OLED element 420.

Here, the current Ioled flowing in the OLED element 420 is determined by a gate-source voltage of the TFT 401, but, this voltage is the voltage held by the capacitive element 410 when the current Idata flow in the data line 103 by the scanning signal Yi of H level. For this reason, when the light emission control signal Vgi became H level, the current Ioled flowing in the OLED element 420 approximately accords with the current Idata flowed just before. In such a manner, the pixel circuit 400A is a current program mode circuit since light emission brightness is defined by the current Idata.

The TFT 401 functions as a driving transistor which supplies the OLED element 420 with the current Ioled. When the threshold voltage of the TFT 401 is Vth and the gate-source voltage thereof is Vgs, and the TFT 401 operates in a saturation region, the current Ioled is given by the following equation.

$$Ioled=\beta(Vgs-Vth)^2/2$$

And then, if the gate-source voltage Vgs falls short of the threshold voltage Vth, the TFT 401 is turned off. In this case, since the current Ioled is not supplied, the OLED element 420 does not emit, such that black is displayed. Therefore, in order to display black, it is necessary to set the gate voltage Vgate so as to satisfy the following equation.

$$Vgs(=Vddr-Vgate)<Vth$$

For this reason, the above-mentioned black voltage VBr is set to satisfy the following equation.

$$Vddr-Vth<VBr$$

Here, the equations regarding R color are described, but the same is applied to the black voltages VBg and VBb of G color and B color. Further, the power supply voltage Vddr may be used as the black voltage VBr. In this case, since there is no need for generating the black voltage VBr specially, it is possible to simply the construction of the power supply circuit 600A.

Figure 4:
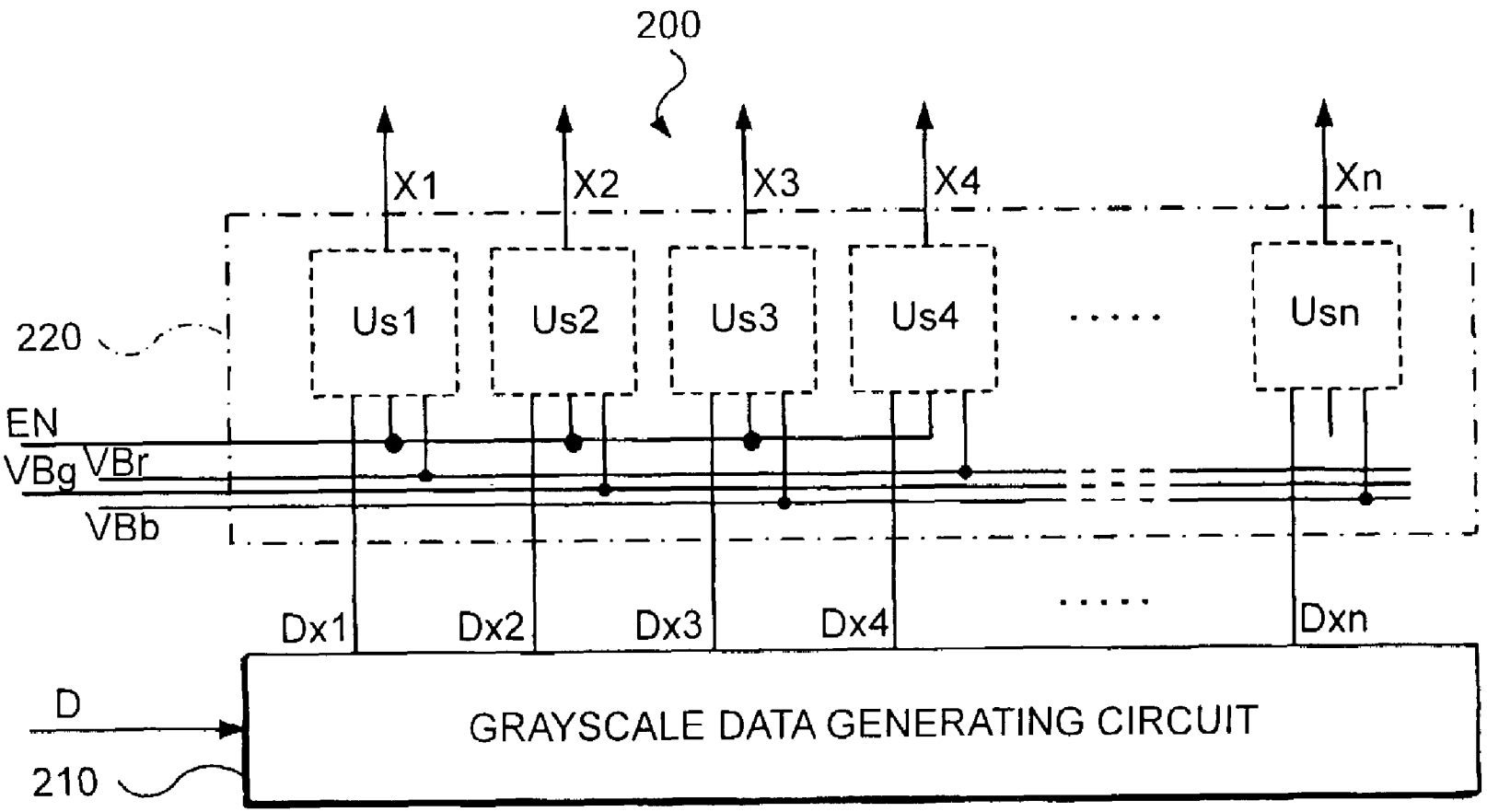
FIG. 4 is a circuit diagram showing a construction of a data line driving circuit in the electro-optical device.

Next, the detailed construction of the data line driving circuit 200 is shown in FIG. 4. The data line driving circuit 200 comprises a grayscale data generating circuit 210 and a grayscale signal supply circuit 220. The grayscale data generating circuit 210 generates grayscale data Dx1 to Dxn in a linear sequence based on dot sequential grayscale data D. FIG. 4 shows an example in which grayscale data Dx1 to Dxn consists of four-bit data. The grayscale signal supply circuit 220 comprises n signal supply units Us1, Us2, . . . and Usn. Here, the black voltage VBr is supplied to the signal supply units Us1, Us4, . . . and Usn-2 corresponding to R color, the black voltage VBg is supplied to the signal supply units Us2, Us5, . . . and Usn-1 corresponding to G color, and the black voltage VBb is supplied to the signal supply units Us3, Us6, . . . and Usn corresponding to B color. The respective signal supply units Us1 to Usn have the same construction, and thus, here, only the signal supply unit Us1 will be described and the descriptions regarding other signal supply units Us2 to Usn will be omitted.

Figure 5:
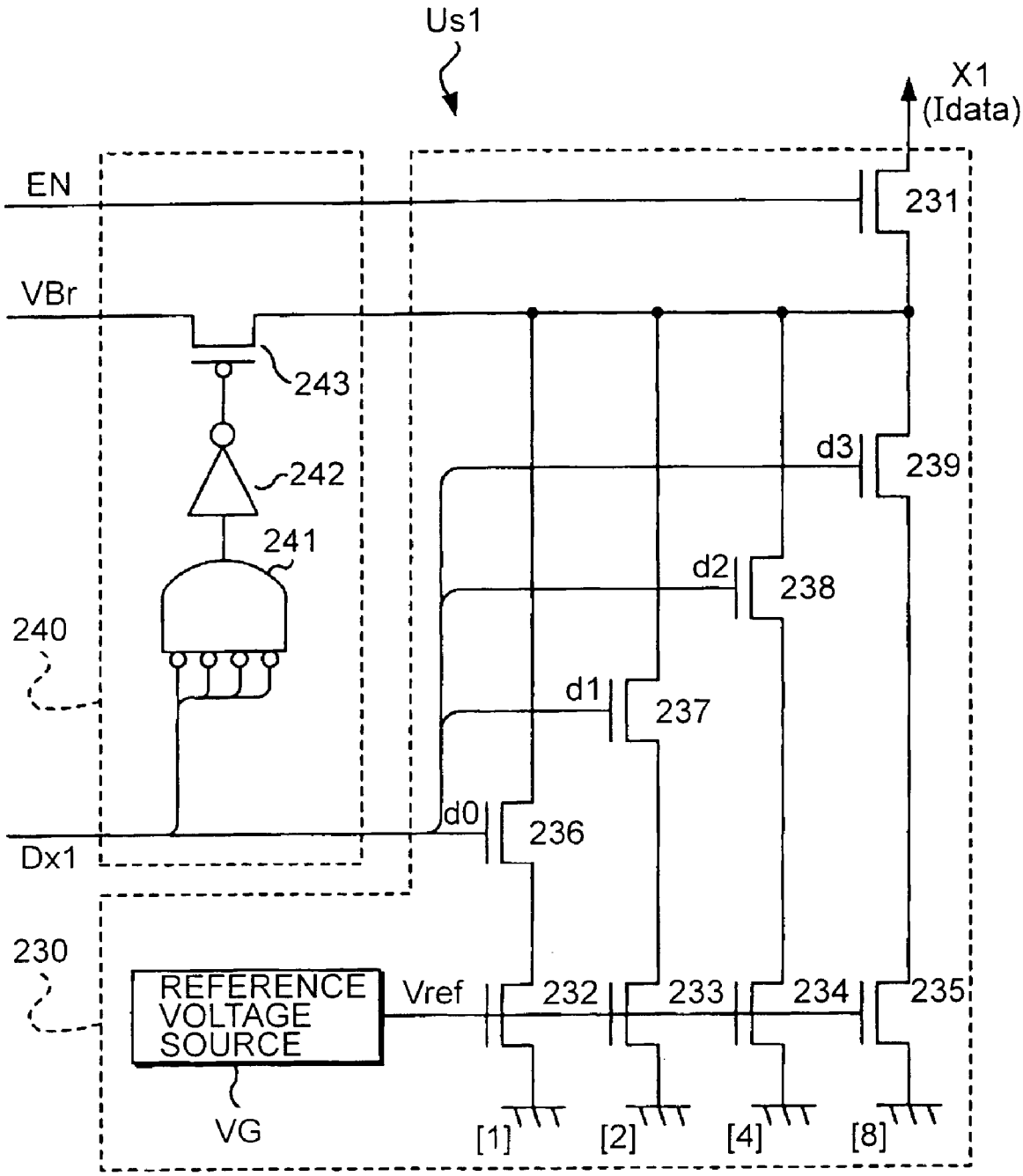
FIG. 5 is a circuit diagram showing an example of a construction of a signal supply unit in the data line driving circuit.

FIG. 5 shows a construction of the signal supply unit Us1. The signal supply unit Us1 comprises a current supply circuit 230 and a voltage supply circuit 240. In the current supply circuit 230, a reference voltage source VG generates a reference voltage Vref and supplies it to gates of transistors 232 to 235. The transistors 232 to 235 function as a constant current source. The ratio of the gate widths of the transistors 232 to 235 are set to 1:2:4:8. Therefore, when a current flowing in the transistor 232 is i, currents flowing in the transistors 232 to 235 become i, 2i, 4i and 8i, respectively. To gates of transistors 236 to 239, bit data d0 to d3 of grayscale data Dx1 are supplied respectively. Sources of the transistors 236 to 239 are connected drains of the transistors 232 to 235 respectively, and drains of the transistors 236 to 239 are connected to a source of the transistor 231. Therefore, depending on On-state or Off-state of each of the transistors 236 to 239, a current is added. The current supply circuit 230 functions as a current addition type D/A converter. To a gate of the transistor 231 which is provided in an output stage, an enable signal EN is supplied. If the enable signal EN becomes active, the signal supply unit Us1 and the data line 103 are connected to each other. Further, in the current supply circuit 230, when grayscale level indicated by grayscale data Dx1 is '0' (black), d0 to d3 become 0, and thus all the transistors 236 to 239 are turned off. In other words, when grayscale level to be displayed is black, the current supply circuit 230 does not output the current Idata and invalidates it. Meanwhile, in the case in which grayscale level to be displayed is not black, the current Idata depending on corresponding grayscale level is outputted.

Next, the voltage supply circuit 240 comprises a NOR circuit 241, an inverter 242 and a p-channel type transistor 243. When grayscale level indicated by grayscale data Dx1 is '0' (black), the four-input NOR circuit 241 sets an output signal active. Further, if the output signal is supplied to the transistor 243 via the inverter 242, the transistor 243 is turned on, such that the black voltage VBr is supplied to the data line 103 via the transistor 231. In other words, when grayscale level to be displayed is black, the voltage supply circuit 240 is validated to output the black voltage VBr, while when grayscale level to be displayed is not black, it is invalidated not to output the black voltage VBr.

Therefore, the current supply circuit 230 and the voltage supply circuit 240 are selectively validated depending on whether or not grayscale level to be displayed is black. And then, when grayscale level to be displayed is black, the black voltage VBr is written into the data line 103. Here, since the black voltage VBr is set so as to turn off the TFT 401 of the pixel circuit 400A as described above, in a writing period in which a data line is selected, it is possible to write a voltage falling short of the threshold voltage Vth into the capacitive element 410. Subsequently, even when the light emission control signal Vgi becomes active, the current Ioled is not supplied to the OLED element 420 because the TFT 401 is turned off. As a result, it is possible to prevent phenomenon such as 'black floating' or 'tailing', and thus it is possible to design improvement of display quality.

2. Second Embodiment

Next, an electro-optical device according to a second embodiment will be described. In the above-mentioned first embodiment, the power supply voltages Vddr, Vddg and Vddb are fixed, but theses voltages may be adjusted. For example, a temperature characteristic of light emission brightness of the OLED element 420 may be corrected by adjusting the power supply voltages. In this case, if the black voltages VBr, VBg and VBb are fixed, it is possible to surely turn on the transistor 401. Besides, the electro-optical device of the second embodiment uses a power supply circuit 600B instead of the power supply circuit 600A.

Figure 6:
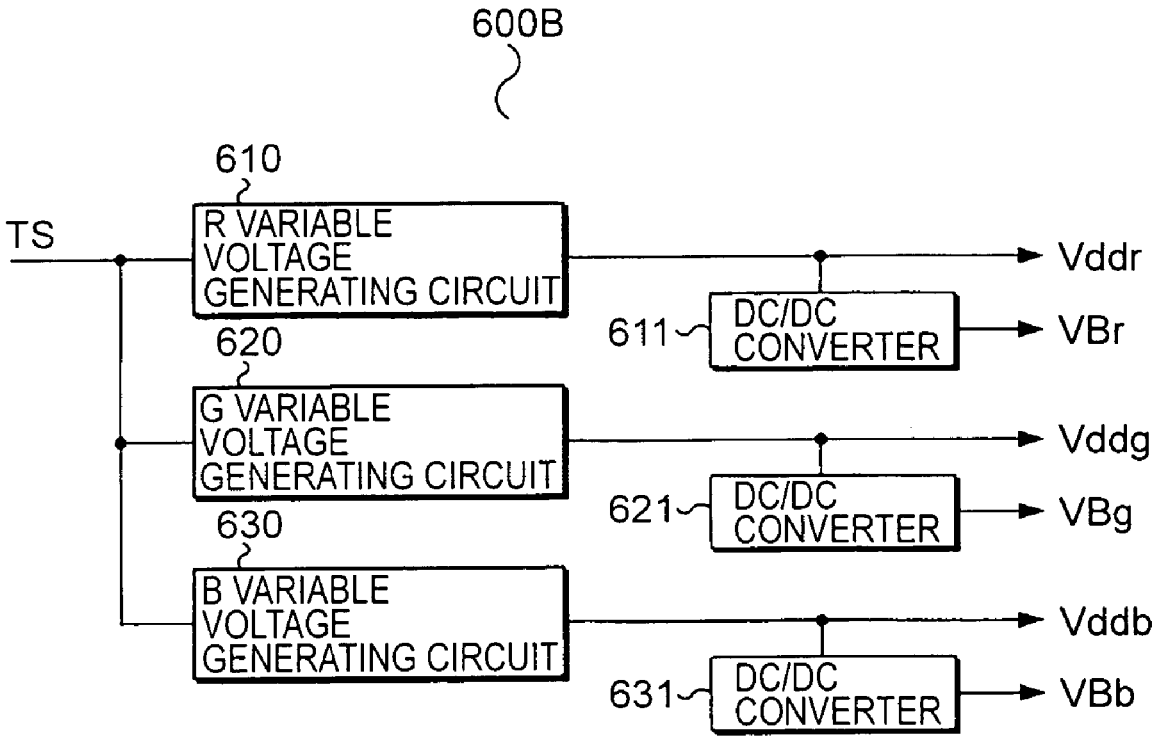
FIG. 6 is a block diagram of a power supply circuit which is used for an electro-optical device according to a second embodiment of the present invention.

FIG. 6 is a block diagram of the power supply circuit 600B. The power supply circuit 600B comprises R, G and B variable voltage generating circuits 610, 620 and 630. To these circuits, a temperature signal TS of the pixel circuit 400A detected by a temperature sensor (not shown) is supplied. The R, G and B variable voltage generating circuits 610, 620 and 630 generates the power supply voltages Vddr, Vddg and Vddb such that light emission temperature characteristic of the OLED element 420 is cancelled. Therefore, the power supply voltages Vddr, Vddg and Vddb change.

DC/DC converters 611, 621 and 631 adjust the power supply voltages Vddr, Vddg and Vddb to generate the black voltages VBr, VBg and VBb, respectively. Here, the adjusting amount ΔV of the voltage is set such that the transistor 401 is turned off. More specifically, when the threshold voltage of the transistor 401 is Vth, ΔV is set to be less than Vth.

As described above, according to the electro-optical device of the present embodiment, even though the power supply voltages Vddr, Vddg and Vddb change, the black voltages VBr, VBg and VBb are generated in association with the changed power supply voltages Vddr, Vddg and Vddb. Thus, it is possible to surely turn off the transistor 401, and it is possible to realize exact black display.

3. Third Embodiment

Next, an electro-optical device according to a third embodiment will be described. Since the data line 103 is accompanied by a parasitic capacitor, charges depending on a writing state are stored in the parasitic capacitor. For this reason, before the writing operation of the current Idata into the data line 103, a precharge voltage is preferably written. In the above-mentioned first embodiment and second embodiment, the supplies of the black voltages VBr, VBg and VBb are common to the application of the precharge voltage in that the voltage is written into the parasitic capacitor of the data line 103. The electro-optical device of the third embodiment is constructed similarly to the electro-optical device of the first embodiment, except that the voltage supply circuit 240 is used as a precharge voltage supply circuit.

Figure 7:
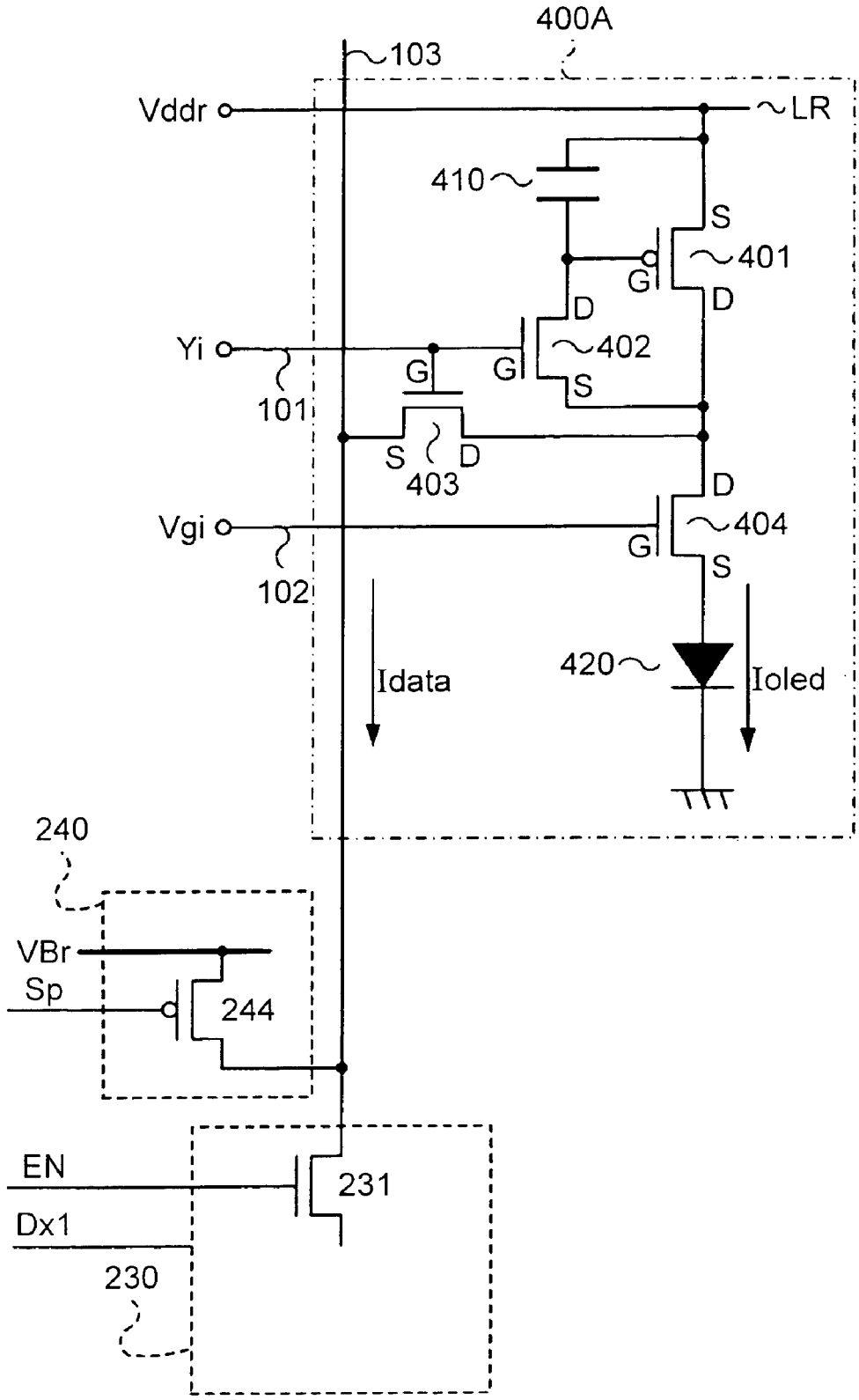
FIG. 7 is a circuit diagram of a voltage supply circuit and its peripheral constructions which are used for an electro-optical device according to a third embodiment of the present invention.
Figure 8:
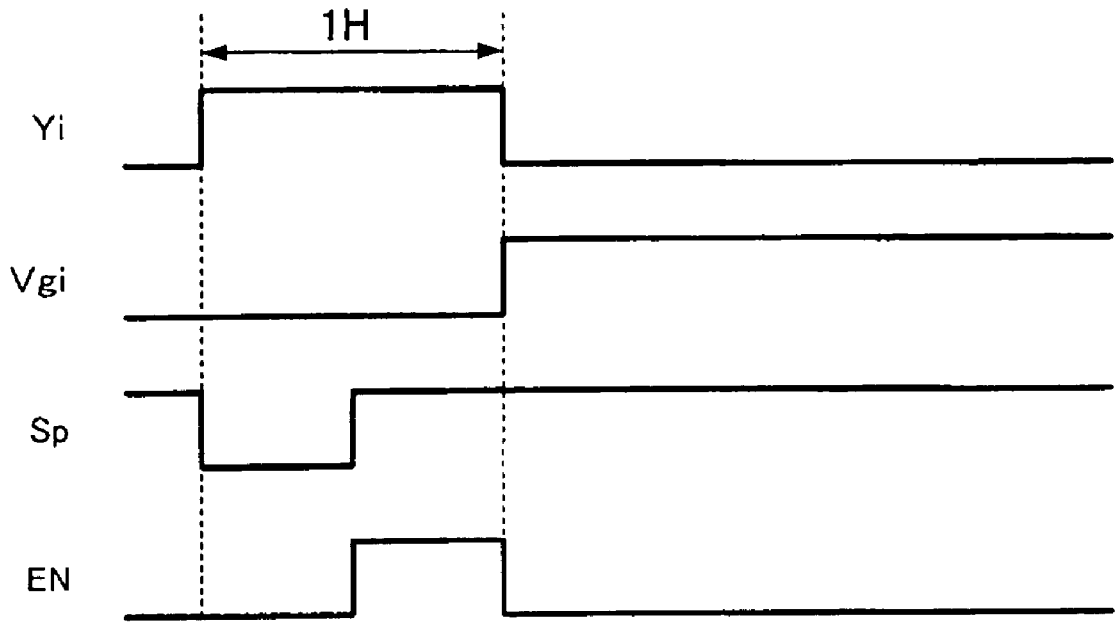
FIG. 8 is a timing chart of the voltage supply circuit and its peripheral constructions.

FIG. 7 shows the voltage supply circuit 240 according to the third embodiment and its peripheral circuits, and FIG. 8 shows a timing chart of them. In this example, the voltage supply circuit 240 is provided with a p-channel type transistor 244. The black voltage VBr is supplied to a drain (or a source) of the transistor 244 of which a source (or a drain) is connected to the data line 103. As shown in FIG. 8, in an initial horizontal scanning period (1H) of one frame, the scanning signal Yi becomes active. In the writing period, the TFT 402 and the TFT 403 of the pixel circuit 400A are turned on, and thus charges are written into the capacitive element 410.

During a first period of the writing period, if a precharge signal Sp becomes L level, the p-channel type transistor 244 is turned on, and the black voltage VBr is written into the data line 103. At this time, since the enable signal EN becomes L level, the transistor 230 is turned off, and the current supply circuit 230 is isolated from the data line 103.

And then, during a second period of the writing period, if the precharge signal Sp becomes H level, the p-channel type transistor 244 is turned off, while the enable signal EN becomes H level, such that the current Idata is written into the data line 103 via the transistor 231. As described above, when grayscale level to be displayed is black, the current supply circuit 230 does not output the current and invalidates it. However, since the black voltage VBr is supplied to the data line 103 in the firs half of the writing period, charges which turn off the TFT 401 are stored in the data line 103 and the capacitive element 410. Meanwhile, when grayscale level to be displayed is not black, the current Idata depending on grayscale level is supplied via the data line 103 during the second period of the writing period. Thus, if the writing period is completed and the light emission control signal Vgi becomes active, the TFT 404 is turned on, and then the current Ioled is supplied to the OLED element 420.

In the present embodiment, since the voltage supply circuit 240 which supplies the black voltages VBr, VBg and VBb has a function of supplying the precharge voltage, it is possible to realize exact black display and a high quality image display with a simple construction.

Figure 9:
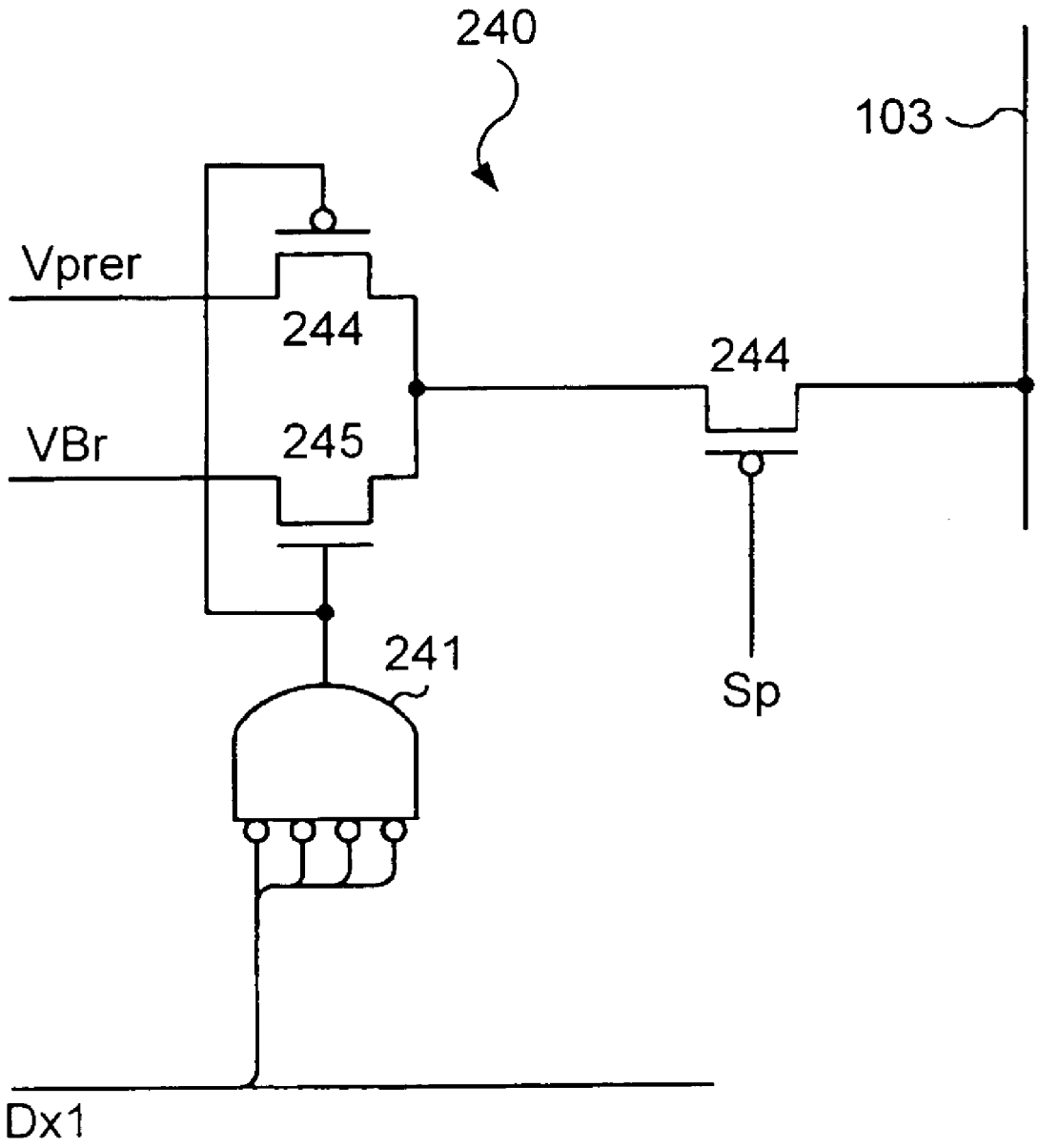
FIG. 9 is a circuit diagram showing an example of a construction of a voltage supply circuit according to a modified example of the third embodiment.

In the present embodiment, the precharge voltage is fixed to the black voltages VBr, VBg and VBb, but, in the present invention, when grayscale level to be displayed is black, the black voltage may be written into the data line 103, and when grayscale level to be displayed is not black, the predetermined precharge voltage may be written into the data line 103. In this case, the voltage supply circuit 240 may be constructed as shown in FIG. 9, for example. In this modified example, grayscale level '0' is detected by the NOR circuit 241, and based on the detection result, the black voltage VBr and the precharge voltage Vprer are switched. More specifically, if the output signal of the NOR circuit 241 becomes H level, the transistor 245 is turned on, and the black voltage VBr is selected. Meanwhile, if the output signal of the NOR circuit 241 becomes L level, the transistor 246 is turned on, and the precharge voltage Vprer is selected.

4. Application

Figure 10:
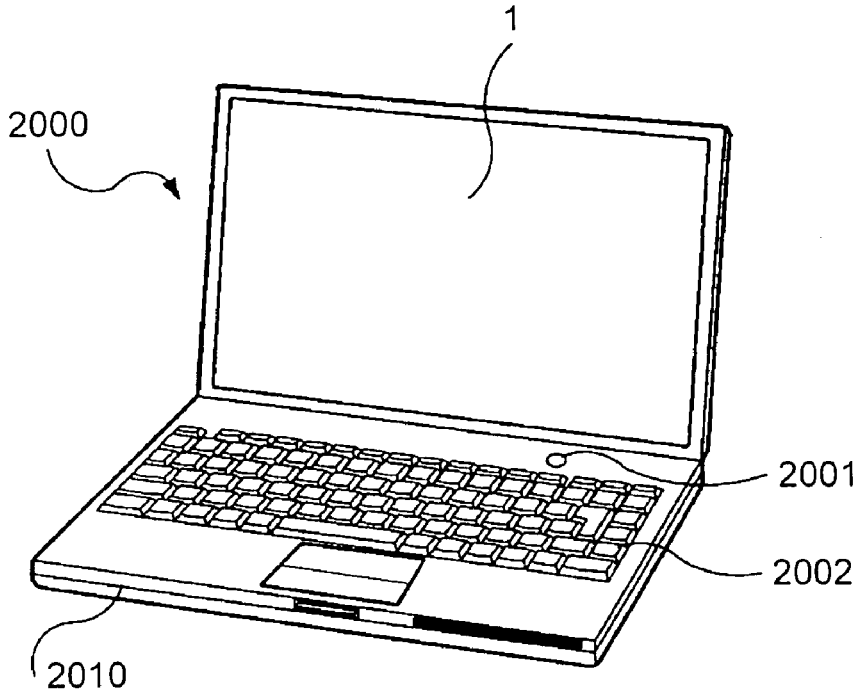
FIG. 10 is a perspective view showing a construction of a mobile type personal computer to which the electro-optical device is applied.

Next, an electronic apparatus to which the electro-optical device 1 according to the above-mentioned embodiment is applied will be described. FIG. 10 shows a construction of a mobile type personal computer to which the electro-optical device 1 is applied. A personal computer 2000 comprises the electro-optical device 1 as a display unit and a main body 2010. In the main body 2010, a power supply switch 2001 and a keyboard 2002 are provided. Since the electro-optical device 1 uses the OLED element 420, it is possible to display a screen easy to view having wide viewing angle.

Figure 11:
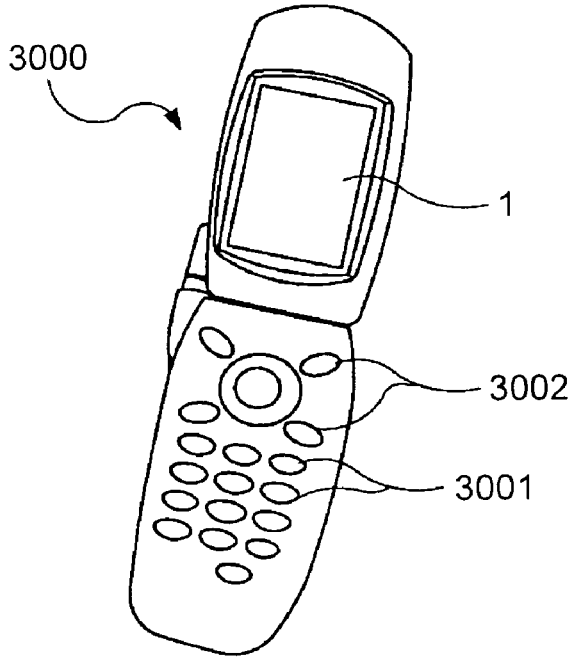
FIG. 11 is a perspective view showing a construction of a cellular phone to which the electro-optical device is applied.

FIG. 11 shows a cellular phone to which the electro-optical device 1 is applied. A cellular phone 3000 comprises a plurality of operating buttons 3001, scroll buttons 3002 and the electro-optical device 1 as a display unit. By operating the scroll buttons 3002, a screen to be displayed on the electro-optical device 1 is scrolled.

Figure 12:
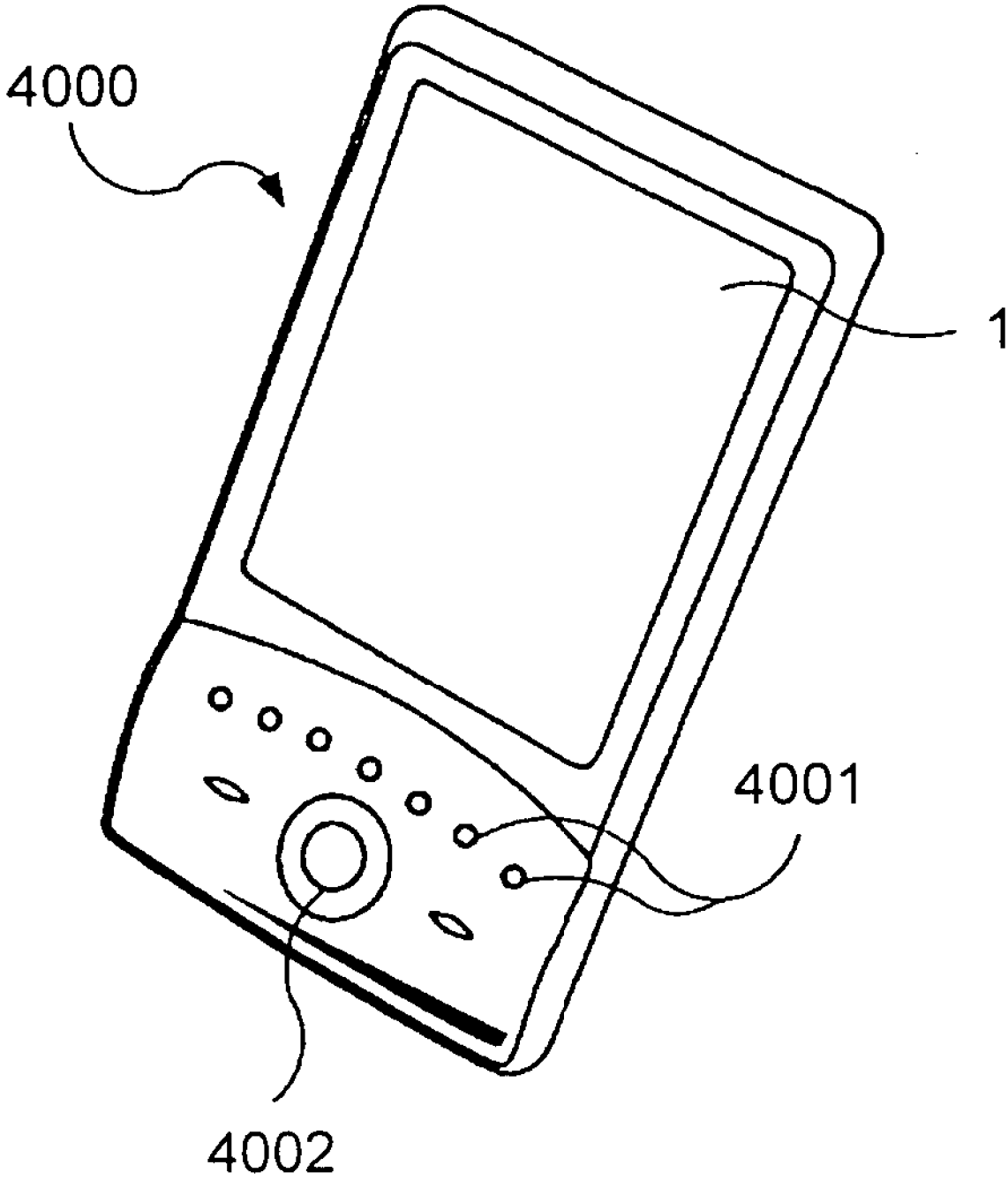
FIG. 12 is a perspective view showing a construction of a personal digital assistant to which the electro-optical device is applied.

FIG. 12 shows a construction of a personal digital assistant (PDA) to which the electro-optical device 1 is applied. A personal digital assistant 4000 comprises a plurality of operating buttons 4001, a power supply switch 4002 and the electro-optical device 1 as a display unit. If the power supply switch 4002 is operated, various information such as an address book, a scheduler, and so on are displayed on the electro-optical device 1.

Moreover, as an electronic apparatus to which the electro-optical device 1, other than ones shown in FIGS. 11 to 13, a digital still camera, a liquid crystal television, a view finder type or monitor-direct-view type video tape recorder, a car navigation device, a pager, an electronic organizer, an electronic calculator, a word processor, a workstation, a videophone, a POS terminal, and an apparatus comprising a touch panel may be included. And then, as the display unit for these electronic apparatuses, the above-mentioned electro-optical device 1 may be applied.

What is claimed is:

1. A driving circuit for an electro-optical device including a plurality of scanning lines, a plurality of data lines, and a plurality of pixel circuits respectively provided at intersections of the scanning lines and the data lines, each of the pixel circuits including a self-luminous element, and a current storing element for supplying current supplied via a data line, the stored current being supplied to the self-luminous element according to a signal supplied to each of the scanning lines, the driving circuit comprising:

voltage supply means for, when a grayscale level to be displayed is a predetermined grayscale level, outputting a predetermined voltage to each of the data lines;

current supply means for, when the grayscale level to be displayed is not the predetermined grayscale level, outputting a current according to the grayscale level to each of the data lines, and the current supply means Setting an output terminal to a high impedance state when the grayscale level to be displayed is the predetermined grayscale level;

control means for, when the grayscale level to be displayed is the predetermined grayscale level, activating the voltage supply means to supply the predetermined voltage and deactivating a current supply from the current supply means, and for, when grayscale level to be displayed is not the predetermined grayscale level, deactivating the voltage supply means and activating the current supply means, the control means connecting the voltage supply means to the data line, during a first period of a writing period in which the data lines are selected, the control means connecting the current supply means to the data line during a second period of the writing period, the voltage supply means writing the predetermined voltage into the data line during the first period of the writing period in which the data lines are selected and when the grayscale level to be displayed is the predetermined grayscale level, the voltage supply means writing a precharge voltage into the data line when the grayscale level to be displayed is not the predetermined grayscale level, and the current supply means during the second period of the writing period in which the data lines are selected, setting the data lines to a high impedance state when a grayscale level to be displayed is a predetermined grayscale level, and supplying a current depending on the grayscale level to be displayed to each of the data lines when the grayscale level to be displayed is not the predetermined grayscale level.

2. The driving circuit according to claim 1, wherein each of the pixel circuits comprises a driving transistor serving as a current source of the self-luminous element, a capacitive element provided between a gate and a source of the driving transistor, and means for storing charges in the capacitive element such that a gate-source voltage of the driving transistor depends on the current supplied via each of the data lines, and wherein the voltage supply means generates, as the predetermined voltage, a voltage that turns off the driving transistor.

3. The driving circuit according to claim 2, further comprising: power supply means for generating a power supply voltage and for supplying the power supply voltage to a source of the driving transistor of each of the pixel circuits, wherein the voltage supply means comprises voltage control means for controlling the predetermined voltage depending on the power supply voltage and generates the predetermined voltage such that the driving transistor is turned off.

4. The driving circuit according to claim 1, wherein the predetermined grayscale level to be displayed is black.

5. An electro-optical device comprising: a plurality of scanning lines; a plurality of data lines; a plurality of pixel circuits respectively provided at intersections of the scanning lines and the data lines, each pixel circuit having a self-luminous element, a driving transistor serving as a current source of the self-luminous element, a capacitive element provided between a gate and a source of the driving transistor, and means for storing charges in the capacitive element such that a gate-source voltage of the driving transistor depends on a current supplied via the data lines; and a driving circuit as claimed in claim 1.

6. The electro-optical device according to claim 5, wherein the self-luminous element is an organic light emitting diode.

7. An electronic apparatus comprising an electro-optical device as claimed in claim 6.

8. A method of driving an electro-optical device including a plurality of scanning lines, a plurality of data lines, and a plurality of pixel circuits respectively provided at intersections of the scanning lines and the data lines, in which each of the pixel circuits includes a self-luminous element, and stores a current supplied via each of the data lines, and supplies the stored current to the self-luminous element according to a signal supplied via each of the scanning lines, the method comprising the steps of:

generating a predetermined voltage when a grayscale level to be displayed is a predetermined grayscale level and generating a precharge voltage when a grayscale level to be displayed is not the predetermined grayscale level;

generating a current depending on grayscale level when the grayscale level to be displayed is not the predetermined grayscale level, and generating a current and setting an output terminal to a high impedance state when the grayscale level to be displayed is the predetermined grayscale level;

supplying the predetermined voltage to each of the data lines when the grayscal'e level to be displayed is the predetermined grayscale level; and supplying the current depending on the grayscale level to be displayed to each of the data lines when the grayscale level to be displayed is not the predetermined grayscale level, supplying a voltage to the data line during a first period of a writing period in which the data lines are selected, and supplying the current to the data line during a second period of the writing period, writing the predetermined voltage into the data line during the first period of the writing period in which the data lines are selected, when the grayscale level to be displayed is the predetermined grayscale level and, writing a precharge voltage into the data line when the grayscale level to be displayed is not the predetermined grayscale level, and during the second period of the writing period in which the data lines are selected, setting the data lines to a high impedance state when a grayscale level to be displayed is a predetermined grayscale level, and supplying a current depending on the grayscale level to be displayed to each of the data lines when the grayscale level to be displayed is not the predetermined grayscale level.

9. The method of driving an electro-optical device according to claim 8, wherein each of the pixel circuits comprises a driving transistor serving as a current source of the self-luminous element, a capacitive element provided between a gate and a source of the driving transistor, and means for storing charges in the capacitive element such that a gate-source voltage of the driving transistor depends on the current supplied via each of the data lines, and wherein the predetermined voltage is a voltage that turns off the driving transistor.

10. The method of driving an electro-optical device according to claim 9, further comprising the steps of generating a power supply voltage to be supplied to a source of the driving transistor of each of the pixel circuits; and controlling the predetermined voltage depending on the power supply voltage such that the driving transistor is turned off.

11. The method of driving an electro-optical device according to claim 7, wherein the predetermined grayscale level to be displayed is black.

12. The method of driving an electro-optical device according to claim 8, wherein the self-luminous element is an organic light emitting diode.

* * * * *